US012650223B2

(12) United States Patent
Demuth

(10) Patent No.: US 12,650,223 B2
(45) Date of Patent: Jun. 9, 2026

(54) BURNER AND PROCESS FOR BURNING A HYDROGEN-CONTAINING FUEL

(71) Applicant: Messer Austria GmbH, Gumpoldskirchen (AT)

(72) Inventor: Martin Demuth, Guntramsdorf (AT)

(73) Assignee: Messer Austria GmbH, Gumpoldskirchen (AT)

( * ) Notice: Subject to any disclaimer, the term of this patent is extended or adjusted under 35 U.S.C. 154(b) by 359 days.

(21) Appl. No.: 18/550,510

(22) PCT Filed: Mar. 17, 2022

(86) PCT No.: PCT/EP2022/056939
§ 371 (c)(1),
(2) Date: Sep. 14, 2023

(87) PCT Pub. No.: WO2022/194991
PCT Pub. Date: Sep. 22, 2022

(65) Prior Publication Data

US 2024/0151393 A1 May 9, 2024

(30) Foreign Application Priority Data

Mar. 17, 2021 (DE) ..... 10 2021 001 419.7

(51) Int. Cl.
*F23D 14/24* (2006.01)
*F23C 1/00* (2006.01)

(52) U.S. Cl.
CPC ..... *F23D 14/24* (2013.01); *F23C 1/00* (2013.01); *F23C 2900/9901* (2013.01)

(58) Field of Classification Search
CPC .... F23D 14/24; F23C 1/00; F23C 2900/9901; F23C 5/06
(Continued)

(56) References Cited

U.S. PATENT DOCUMENTS 2,669,296 A * 2/1954 Stillman ..... F23D 11/00 431/186
4,813,867 A 3/1989 Yoshida et al.
(Continued)

FOREIGN PATENT DOCUMENTS

DE 1060082 B * 6/1959
EP 3333481 A1 6/2018
(Continued)

OTHER PUBLICATIONS

International Search Report and Written Opinion in PCT/EP2022/056939, dated Jul. 15, 2022, 6 pages.

*Primary Examiner* — Vivek K Shirsat
(74) *Attorney, Agent, or Firm* — Andrus Intellectual Property Law, LLP

(57) ABSTRACT

A burner for burning a hydrogen-containing fuel is equipped with a burner unit which comprises a fuel feed and a feed for a primary oxidant (oxygen) and which is accommodated in a feed for a secondary oxidant (air). A swirl device whose relative position with respect to the burner unit can be altered is provided in the feed for the secondary oxidant. The relative position of the burner unit and the swirl device may be controlled according to a composition of the fuel, in particular according to the water content thereof and the ratio of primary and secondary oxidant. The burner allows flexible adaptation of the burning to fuels of different composition, even during ongoing operation.

15 Claims, 4 Drawing Sheets

(58) Field of Classification Search
USPC ..... 431/12, 189
See application file for complete search history.

(56) References Cited

U.S. PATENT DOCUMENTS

| | | | | |
|---|---|---|---|---|
| 2009/0111064 | A1 | 4/2009 | Li et al. | |
| 2016/0076763 | A1* | 3/2016 | Bätz | F23D 17/00<br>431/187 |

FOREIGN PATENT DOCUMENTS

| | | | |
|---|---|---|---|
| EP | 3450843 | A1 | 3/2019 |
| IT | UB20156239 | A1 | 6/2017 |
| WO | 0061992 | A1 | 10/2000 |
| WO | 2009068424 | A1 | 6/2009 |

* cited by examiner

BURNER AND PROCESS FOR BURNING A HYDROGEN-CONTAINING FUEL

CROSS-REFERENCE TO RELATED APPLICATIONS

The present application is the U.S. national stage application of international application PCT/EP2022/056939, filed Mar. 17, 2022, which international application was published on Sep. 22, 2022, as International Publication WO 2022/194991 A1. The international application claims priority to German Patent Application No. 10 2021 001 419.7 filed Mar. 17, 2021. The above-noted applications are hereby incorporated herein by reference.

FIELD

The invention relates to a burner for combustion of a hydrogen-containing fuel, comprising a burner unit which is accommodated within a feed for a secondary oxidant and comprises a fuel feed connected to an inlet for a hydrogen-containing fuel and a feed for a primary oxidant, and comprising a swirl device disposed in the feed for the secondary oxidant. The invention further relates to a method of combustion of a hydrogen-containing fuel with an oxygen-containing oxidant.

BACKGROUND

EP 3 333 481 A1 discloses a burner for combustion of hydrogen. The burner has a coaxial construction, with a central fuel feed for hydrogen and feeds arranged coaxially to the latter for a primary and a secondary oxygen-containing oxidant. However, no additional combustion of other fuels than hydrogen or swirl device is envisaged here.

EP 3 450 843 A1 discloses a burner for combustion of hydrogen gas, in which an oxidant feed is disposed concentrically within a tubular feed for hydrogen gas. In operation of the burner, a tubular flame is thus formed within the outer feed. No supplementary combustion of other fuels is envisaged in the case of this subject matter either.

WO 2009/068424 A1 discloses a premix burner for combustion of a hydrogen-containing synthesis gas, in which a hydrogen or hydrogen-containing synthesis gas and a further liquid or gaseous fuel are fed radially into a swirled air stream. The resultant gas mixture is mixed vigorously because of the swirl flow and introduced into a combustion chamber in which it is reacted. In the case of this subject matter, however, no change in the composition of the fuel in the course of operation is envisaged.

SUMMARY

It is an object of the invention to specify a burner and a method of combustion of a hydrogen-containing fuel with an oxygen-containing oxidant, which can be used flexibly with different compositions of the fuel, especially at different hydrogen contents, and shows good results within a wide range with regard to economic viability and pollutant emissions.

The burner of the invention for combustion of a hydrogen-containing fuel comprises at least one fuel feed and at least one feed each for a primary oxidant and a secondary oxidant. The at least one fuel feed and at least one feed for a primary oxidant are accommodated within the/a feed for a secondary oxidant and are also referred to collectively hereinafter as "burner unit". For example, the fuel feed(s) and the feed(s) for the primary oxidant are executed as, for example, tubes in a concentric or parallel arrangement that are closed on the shell side, in a concentric arrangement within a likewise tubular feed for the secondary oxidant. However, other configurations are also conceivable in the context of the invention, for example a burner unit in which a central feed for fuel (or for primary oxidant) is surrounded radially by a multitude of mutually axially parallel feeds for the primary oxidant (or for the fuel).

Upstream of the actual fuel feed is a mixing zone into which there open an inlet for a hydrogen-containing fuel, in particular for pure hydrogen having a purity exceeding 99% by volume, and at least one inlet for a second gaseous fuel. The mixing zone is, for example, a pipeline section upstream of the fuel feed, or a mixing chamber or a rear section of the fuel feed which, in the installed state of the burner, is spaced apart from a mouth of the burner into a treatment space, for example a furnace space or a combustion chamber.

Provided in the feed for the secondary oxidant and preferably radially on the outside of the burner unit is a swirl device, by means of which the stream of the secondary oxidant introduced into the treatment space in a manner known per se is forced into a helical pathway, and hence a flow direction can be defined. The swirl device is arranged such that burner unit and swirl device are movable relative to one another, i.e. the swirl device relative to the burner unit and the feed for the secondary oxidant and/or the burner unit relative to the swirl device and the feed for the secondary oxidant. Burner unit and/or swirl device are moved by means of a manually actuated or motor-driven movement device. For example, the swirl device is a body equipped with air-directing elements which is arranged around the burner unit, which is movable axially with respect to the burner unit and/or the burner unit is movable axially with respect to the latter, and where continuous movement of the swirl device and/or of the burner unit is possible between a first position where swirl device and burner unit mouth lie close to one another and a second position where the swirl device has been retracted with respect to the mouth of the burner unit in the feed for the secondary oxidant.

In operation of the burner, hydrogen or a mixture of hydrogen and a second gaseous fuel produced beforehand in the mixing zone are introduced into a treatment space, wherein means are provided, for instance valves, by which the flow rates of hydrogen and the second fuel and the ratio thereof are variably adjustable. The primary and secondary oxidants are introduced into the treatment space via the corresponding feeds and are only reacted with the fuel once therein. The flow rates of primary and secondary oxidant and the ratio thereof can also be adjusted independently of one another via suitable means, for instance valves. By varying the relative positions of swirl device and burner unit, it is possible to vary the flow profile of the secondary oxidant introduced into the treatment space in a controlled manner.

The primary oxidant is preferably pure oxygen, and the secondary oxidant air. "Pure oxygen" in the context of this invention is understood to mean oxygen having a purity of at least 90% by volume. The hydrogen-containing fuel is preferably pure hydrogen having a purity of at least 99% by volume. The second gaseous fuel preferably contains only negligibly small amounts, if any, of hydrogen. For example, this is natural gas and/or a gas or gas mixture having a high inert gas content and low calorific value (lean gas).

In a preferred embodiment, at least one fuel feed and one feed for the primary oxidant are designed as mutually concentric cylindrical tubes having no flow connection to one another. There is preferably a fuel feed disposed centrally within a feed for the primary oxidant. In a particularly preferred configuration, the fuel feed and the feed for the primary oxidant open out flush with one another at a burner mouth of the burner unit in the direction of the treatment space.

The burner unit is preferably disposed concentrically within the likewise cylindrical feed for the secondary oxidant, with the mouth of the burner unit in the installed state preferably in a retracted arrangement with respect to the mouth of the feed for the secondary oxidant into the treatment space, in order to protect the burner unit from the effect of heat from the treatment space. The feed for the second oxidant is formed either as a tube installed in a burner receptacle (burner block) or is formed by a corresponding cylindrical hole in the burner block itself.

In an advantageous configuration of the burner of the invention, the burner unit has at least two fuel feeds and/or at least two feeds for the primary oxidant. With such an arrangement, there is in particular a further opportunity to influence the geometry or temperature of a flame that forms in the treatment space.

The burner of the invention is preferably used in a method of combustion of a hydrogen-containing fuel with an oxygen-containing oxidant in a treatment space, which is characterized by the following steps:

- hydrogen is introduced via the inlet for hydrogen and optionally mixed in the mixing zone upstream of the burner feed with a second gaseous fuel that has been fed in via the inlet for the second gaseous fuel, and the hydrogen or the mixture (generally referred to hereinafter as "fuel") is introduced into a treatment space via the fuel feed,
- a primary oxidant, for example pure oxygen, is simultaneously introduced into the treatment space via the feed for the primary oxidant, and optionally a secondary oxidant, for example air, via the feed for the second oxidant,
- the fuel and the oxidant(s) are reacted with one another in the treatment space,
- depending on the chemical composition of the fuel introduced into the treatment space, especially on the hydrogen content or calorific value thereof, and/or on the ratio of primary and secondary oxidant fed to the treatment space, the flow profile of the secondary oxidant introduced into the treatment space is varied according to a defined program, where the flow profile is altered by varying the relative position of swirl device and burner unit.

The relative position of burner unit and swirl device is controlled, for example, in the following manner.

Because of the low ignition temperature and the high flame speed in the combustion of hydrogen, a high hydrogen content in the fuel leads to higher temperatures in the region of the burner mouth into the treatment space. In this case, it is advantageous to leave vigorous mixing of oxidants and fuel until as late as possible. This is especially true in the case of high oxygen contents in the oxidant, since this is associated with relatively high reaction temperatures and a relatively low flow rate that drives the flame from the burner mouth. In the limiting case of pure, or virtually pure, hydrogen-oxygen combustion, the swirl device, which is only of minor significance anyway in this case because of the low proportion of secondary oxidant, is then preferably in a retracted position in the burner receptacle, as far as possible removed from the flame and the mouth opening of the burner unit.

The lower the hydrogen content in the fuel and/or the higher the air content in the oxidant, the lower the flame temperature will be, and the flame will move away from the burner mouth because of the greater mass flow rate. In this situation, vigorous mixing of fuel and oxidant by means of the swirl device as close as possible upstream of the burner mouth is advantageous; according to the invention, this is accomplished, for example, in that swirl device and burner mouth converge, either in that the swirl device, when it is movable, is advanced in the direction of the burner mouth or in that the burner, when it is movable, is pushed back, in the direction away from the combustion chamber, relative to the swirl device which is fixed in a swirl grid in the burner receptacle.

Moreover, it is also possible with the burner of the invention to control the ratio and absolute values of the flow rates of primary oxidant (pure oxygen in particular) and secondary oxidant (air in particular) depending on a composition of the fuel fed to the treatment space according to a defined program and/or depending on measured parameters.

The burner of the invention may especially be operated with a fuel mixture consisting of hydrogen and natural gas and/or another gaseous fuel, in particular lean gas, and with pure oxygen as first oxidant and air as second oxidant, where the ratio of hydrogen to natural gas and/or the ratio of oxygen and air may be varied within a wide range even during operation.

The burner of the invention and the method of the invention are preferably also suitable for implementing flameless combustion in the treatment space. For this purpose, the streams of fuel and the primary and/or secondary oxidant are introduced into the treatment space with such high momentum as to result in intensive recirculation of the offgases in the treatment space, and consequently in development of flameless combustion.

BRIEF DESCRIPTION OF THE DRAWINGS

Working examples of the invention are to be elucidated in detail with reference to the drawings. The figures show, in schematic views.

DETAILED DESCRIPTION

Figure 1:
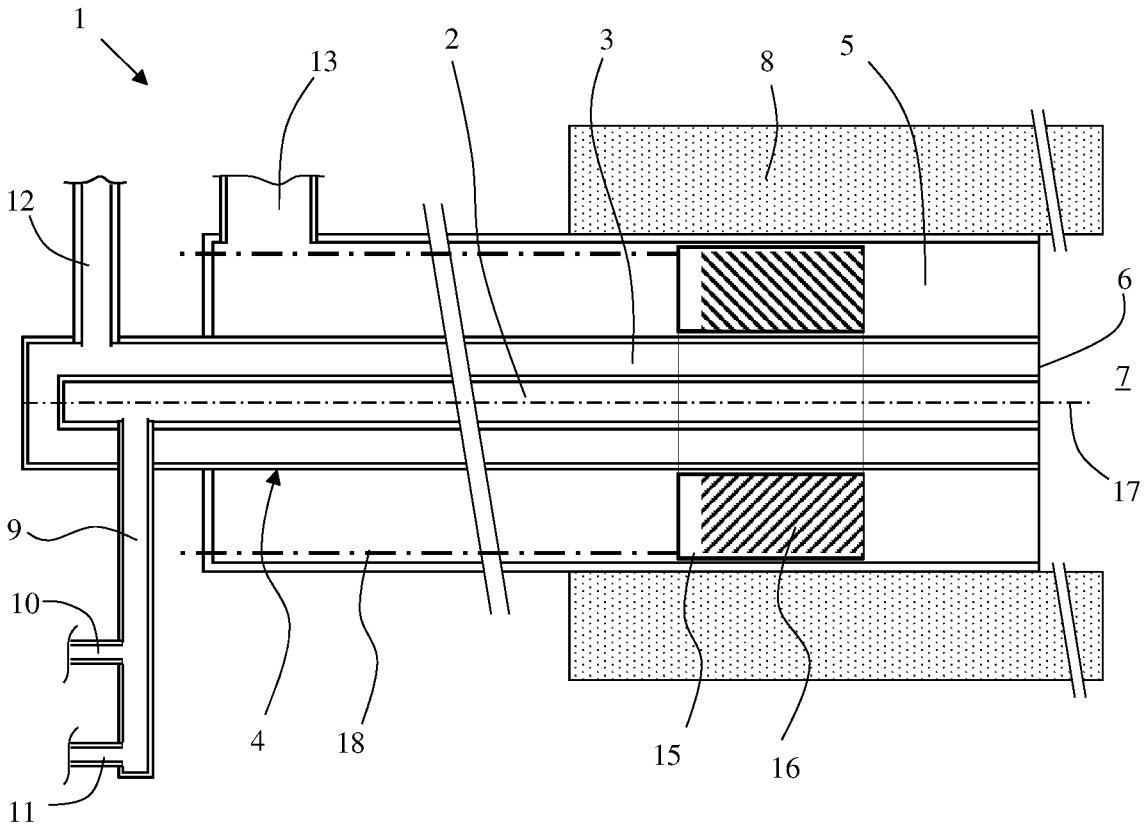
FIG. 1 shows a burner of the invention in a first embodiment in longitudinal section in a first operating position.
Figure 2:
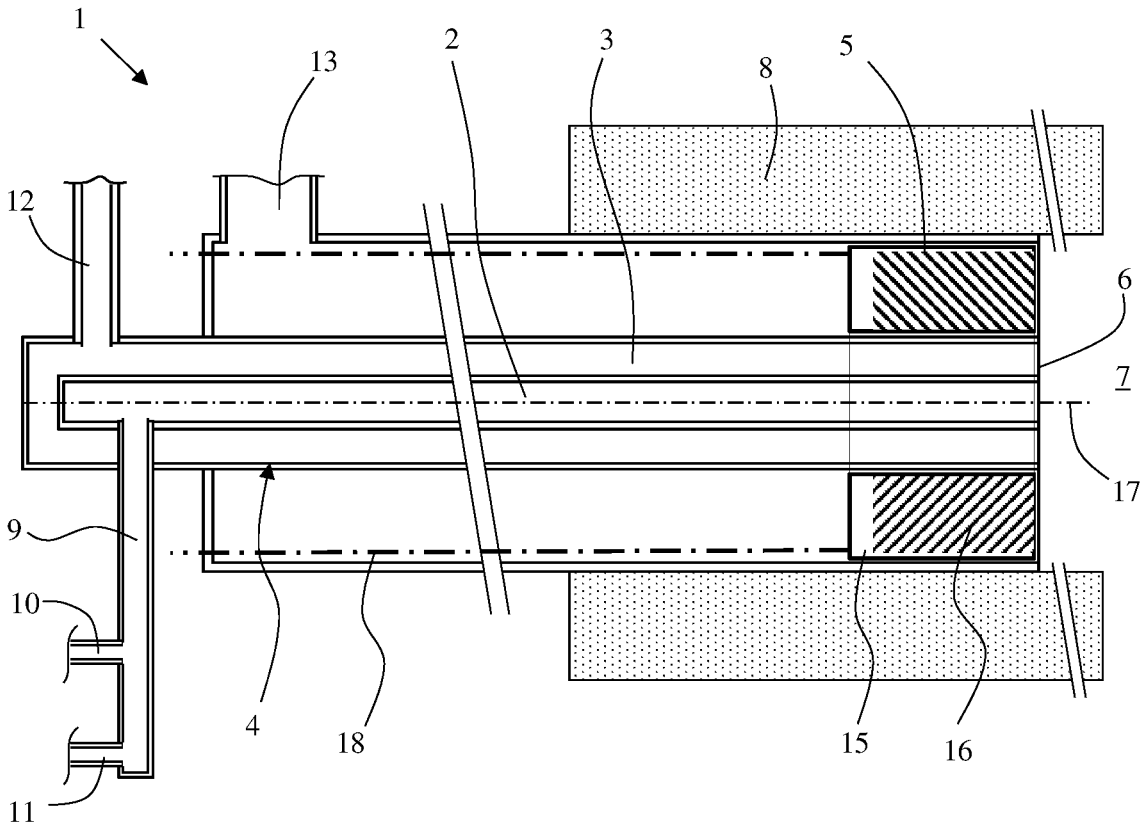
FIG. 2 shows the burner from FIG. 1 in a second operating position.

The burner 1 shown in sections in FIGS. 1 and 2 comprises, in a coaxial arrangement, a central fuel feed 2 surrounded radially on the outside by a feed 3 for a primary oxidant, for example oxygen; fuel feed 2 and feed 3 for the primary oxidant together form a hydrogen/oxygen burner unit 4. The burner unit 4 is adjoined radially on the outside, and coaxially thereto, by a feed 5 for a secondary oxidant, for example air. The feeds 2, 3, 5 open out at a burner mouth 6 into a treatment space 7, which is, for example, a combustion chamber or a furnace space. The foremost section of the burner 1 facing the treatment space 7 is framed in a burner receptacle (burner block) 8, retracted with the burner mouth 6 with respect to the treatment space 7.

The fuel feed 2 is fluidically connected via a pipe section 9 to two inlets 10, 11, via which respectively different gaseous fuels are introduced and are mixed with one another in the pipe section 9, before the resultant fuel mixture is introduced into the treatment space 7 via the fuel feed 2. In particular, pure gaseous hydrogen is introduced via inlet 10, and a second gaseous fuel with a low level of hydrogen, for example natural gas, via inlet 11.

In the working example shown here, an inlet 12 for pure oxygen (with a purity of more than 90% by volume) which is fluidically connected to an oxygen source (not shown here), for example a stationary tank, opens out into the feed 3 for primary oxidant, and an inlet 13 for air into the feed 5. The feeds 2, 3, 5 have no flow connection with one another over their entire length up to the burner mouth 6. Only upstream of the burner mouth 6 is there mixing of the gases introduced via feeds 2, 3, 5. Not shown in the drawings, but nevertheless present, is an ignition device of customary design for ignition of the fuel-oxidant mixture introduced into the treatment space 7.

A swirl device 15 is disposed in the feed 5 for the secondary oxidant. The swirl device 15, in the working example shown here, extends coaxially around the burner unit 4 and is equipped with air-guiding elements 16 in a spiral arrangement, by means of which the gas stream introduced via the feed 5 is forced into a swirling motion about a burner axis 17.

The swirl device 15, in the working example shown in FIGS. 1 and 2, is in an axially movable arrangement within the feed 5, and it can moved even during operation by means of drive mechanics 18 that are merely indicated here by dashed—and—dotted lines. The swirl device 15 may be moved continuously between a position in which, as shown in FIG. 1, it is deep within the feed 5, away from the burner mouth 6, and a position in which, as shown in FIG. 2, it concludes flush, or at least virtually flush, with the burner mouth 6 by a front face.

Figure 3:
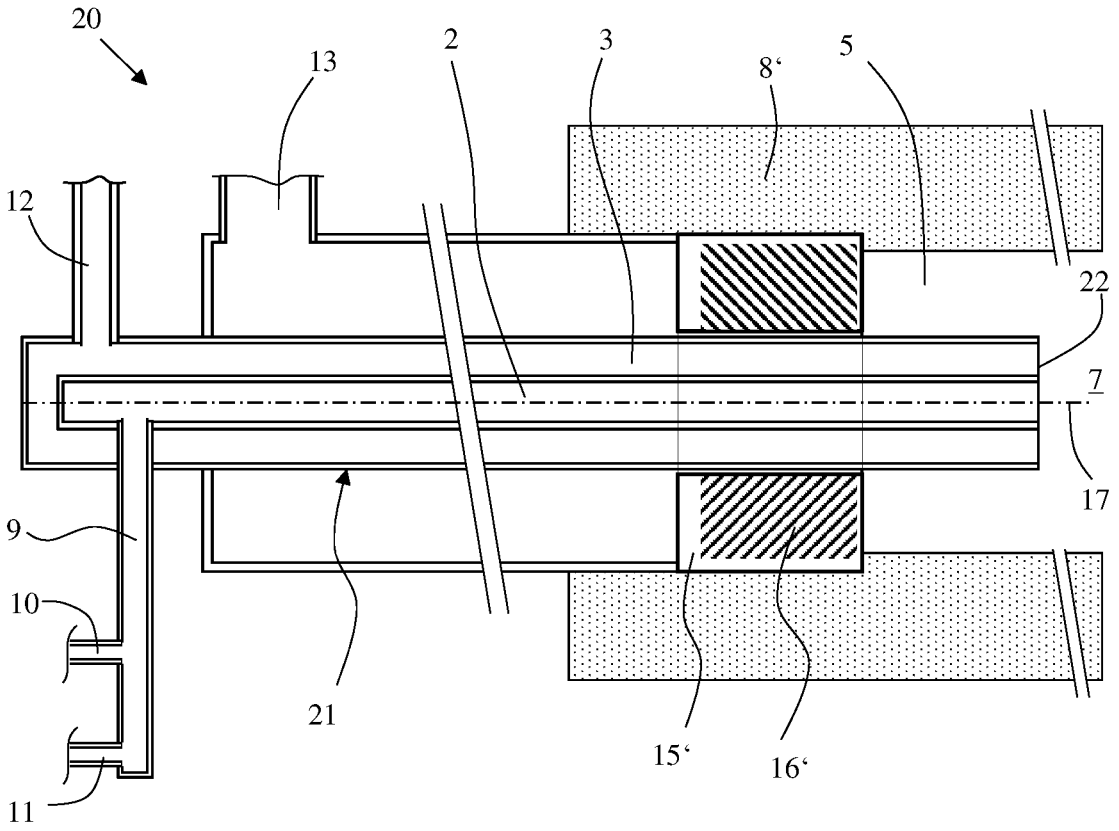
FIG. 3 shows a burner of the invention in a second embodiment in longitudinal section in a first operating position.
Figure 4:
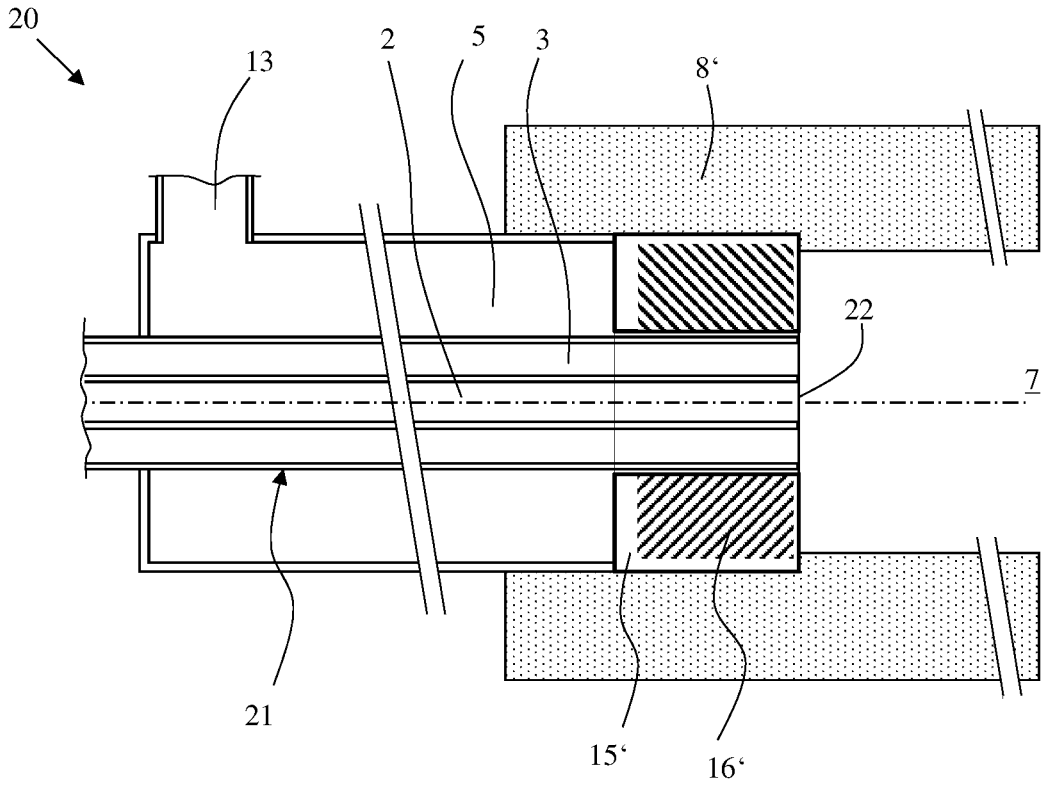
FIG. 4 shows the burner from FIG. 3 in a second operating position.

The burner 20 shown—only by its front section—in FIG. 3 and FIG. 4, in which, incidentally, elements having the same effect have been given the same reference numerals as in the burner 1 in FIGS. 1 and 2, differs from the burner 1 merely in that a swirl device 15' that is not movable axially with respect to the feed 5 is incorporated in the feed 5 for the secondary oxidant. The swirl device 15' is equipped in a customary manner with spiral air-guiding elements 16' and is fixedly connected to a burner receptacle 8' to give a swirl grid. The swirl device 15' here is mounted in a retracted position in the burner receptacle 8' in order to prevent damage by the effect of heat from the treatment space 7.

At the same time, in the working example according to FIGS. 3 and 4, the burner unit 21 formed from the feeds 2 and 3 is movable axially with respect to the burner receptacle 8', and hence with respect to the swirl device 15'. The burner unit 21 may by means of a movement device 23 continuously between a position in which, as shown in FIG. 3, it projects within the burner receptacle 8' in the direction of the treatment space 7 at a distance from the swirl device 15' and a position in which, as shown in FIG. 4, it is retracted with a front face flush, or at least virtually flush, with the swirl device 15' in the burner receptacle 8'.

The burners 1, 20 are intended, in particular, to burn a mixture composed of the components hydrogen and a second gaseous fuel, for instance natural gas and/or a lean gas, in a variable composition that also changes during operation with an oxidant consisting of oxygen or an oxygen-air mixture in likewise variable composition. Since the different compositions of fuel and oxidant lead to different flame geometries and temperatures, it is additionally necessary during operation to adjust the flow ratios implemented by the swirl device 15, 15'.

FIGS. 1 and 3 show a situation in which a fuel having a high hydrogen content—pure hydrogen in the limiting case—is burnt with an oxygen-rich (relative to air) primary oxidant—pure oxygen in the limiting case—which is introduced into the treatment space 7 via the feed 3. In this case, not only does the combustion lead to high flame temperatures, but the comparatively minor or completely absent stream of secondary oxidant (air) via the feed 5 leads to formation of a flame in the treatment space 7 close to the burner mouth 6.

The swirl device 15, 15' here is in a retracted position deep in the burner receptacle 8, 8' for protection from heat. The high momentum of the gases entering the treatment space 7 from the feeds 2, 3 leads to intensive recirculation of parts of the atmosphere in the treatment space 7, which can subsequently result in flameless combustion in the treatment space 7.

As the proportion of secondary oxidant (air) introduced via the feed 5 in the overall oxidant introduced into the treatment space 7 (collectively "oxidant" hereinafter) rises, the mass flow introduced into the treatment space 7 increases, the flame moves away from the burner mouth 6, and the swirl device 15, 15' is cooled by the stream of the second oxidant. In order to assure good mixing of fuel and oxidant in this case, the swirl device 15, 15' and burner unit 4, 21 are moved such that the foremost section of the swirl device 15, 15' facing the treatment space 7 and the mouth of the burner unit 4, 21 converge. The closer the swirl device 15, 15' and the mouth of the fuel feed 2 move together, the greater the influence of the swirled oxidant stream on the fuel stream. What is described in particular by the limiting case shown in FIGS. 2 and 4 is a situation in which virtually no primary oxidant (oxygen), if any, is introduced via the feed 3, and the oxidant instead consists virtually exclusively of secondary oxidant (air) which is introduced via feed 5.

With varying compositions of fuel and/or oxidant, the position of the swirl device 15 or burner unit 21 may be changed during operation and matched to the respective demands and controlled. This is effected either manually or by means of an automatic controller (not shown here) according to a defined program. For example, the relative position of the swirl device 15, 15' relative to the burner unit 4, 21 may be controlled depending on a measured hydrogen concentration in the fuel fed in or a temperature in the treatment space 7. Incidentally, the swirl device 15, 15', in the limiting case of maximum input of secondary oxidant via the feed 5, need not in any way, as shown here, conclude flush with the mouth of the fuel feed 2. Instead, the position of the swirl device which is preferred for the combustion process depends on the geometry and alignment of the air-guiding elements 16, 16'.

Moreover, it is also conceivable in the context of the present invention to provide a further feed for primary oxidant (oxygen) in the burner unit 4, 21, in order to be able to still better vary the flame geometry.

In addition, the inventive burner 1, 20 is especially also suitable for combustion of lean gases of low calorific value, which for this purpose is mixed with the second gaseous fuel (natural gas) or used exclusively as second gaseous fuel and introduced into the treatment space 7 via the inlet 11, the pipe section 9 and the fuel feed 2.

LIST OF REFERENCE NUMERALS

1 burner
2 fuel feed

3 feed for primary oxidant
4 burner unit
5 feed for secondary oxidant
6 burner mouth
7 treatment space
8, 8' burner receptacle
9 pipe section
10 inlet (for hydrogen)
11 inlet (for natural gas)
12 inlet (for oxygen)
13 inlet (for air)
14 -
15, 15' swirl device
16, 16' air-guiding elements
17 burner axis
18 drive mechanics
19 -
20 burner
21 burner unit
22 mouth (of the burner unit)

The invention claimed is:

1. A burner for combustion of a hydrogen-containing fuel, the burner comprising:

a burner unit which is accommodated within a feed for a secondary oxidant and comprises a fuel feed connected to an inlet for a hydrogen-containing fuel and a feed for a primary oxidant; and a swirl device disposed in the feed for the secondary oxidant;

wherein upstream of the fuel feed of the burner unit is a mixing zone into which opens the inlet for hydrogen-containing fuel and at least one inlet for a second gaseous fuel; and wherein the swirl device is accommodated within the feed for the secondary oxidant so as to be movable axially with respect to the feed for the secondary oxidant and with respect to the burner unit.

2. The burner as claimed in claim 1, wherein the fuel feed and the feed for the primary oxidant are arranged concentrically to one another in the burner unit, and the latter is disposed concentrically within the feed for the secondary oxidant.

3. The burner as claimed in claim 1, wherein the fuel feed and the feed for the primary oxidant open out flush with one another at a mouth of the burner unit that faces a treatment space.

4. The burner as claimed in claim 1, wherein the burner unit is accommodated within the feed for the secondary oxidant so as to be movable axially with respect to the latter and with respect to the swirl device.

5. The burner as claimed in claim 1, wherein the burner unit has at least two fuel feeds.

6. A method of combustion of a hydrogen-containing fuel with an oxygen-containing oxidant in a treatment space using the burner as claimed in claim 1, wherein hydrogen via the inlet for hydrogen-containing fuel and optionally a second gaseous fuel via the inlet for the second gaseous fuel are mixed in the mixing zone and introduced into a treatment space via the fuel feed;

a primary oxidant is simultaneously introduced into the treatment space via the feed for the primary oxidant, and optionally a secondary oxidant via the feed for the secondary oxidant;

the fuel and the oxidant(s) are mixed with one another and reacted in the treatment space;

depending on the chemical composition of the fuel introduced into the treatment space and/or the ratio of primary and secondary oxidant fed to the treatment space, the flow profile of the secondary oxidant introduced into the treatment space, which is determined by the relative position of the swirl device and the burner unit, is varied according to a defined program.

7. The method as claimed in claim 6, wherein the primary oxidant used is oxygen and the secondary oxidant used is air.

8. The method as claimed in claim 6, wherein the second gaseous fuel used is natural gas and/or a lean gas having low calorific value.

9. The method as claimed in claim 6, wherein the ratio of the flow rates of primary and secondary oxidant is controlled depending on a composition of the fuel fed to the treatment space according to a defined program and/or depending on measured parameters.

10. The method as claimed in claim 6, wherein there is flameless combustion in the treatment space.

11. The burner as claimed in claim 1, wherein the burner unit has at least two feeds for the primary oxidant.

12. The burner as claimed in claim 1, further comprising a controller and a drive mechanism configured to axially move the swirl device, wherein the controller is configured to control the drive mechanism to axially move the swirl device during operation of the burner.

13. The burner as claimed in claim 12, wherein the controller is configured to control the drive mechanism to axially move the swirl device based on a measured hydrogen concentration in the fuel feed.

14. The burner as claimed in claim 12, wherein a mouth of the burner unit faces a treatment space; and wherein the controller is configured to control the drive mechanism to axially move the swirl device based on a temperature in the treatment space.

15. The burner as claimed in claim 1, wherein the swirl device is axially movable into and between a first position in which the swirl device is retracted relative to the burner unit and a second position in which the swirl device is flush with a mouth of the burner unit.

* * * * *